US007915795B2

(12) United States Patent
Jaffrezic et al.

(10) Patent No.: US 7,915,795 B2
(45) Date of Patent: Mar. 29, 2011

(54) SPARKPLUG FOR AN INTERNAL COMBUSTION ENGINE

(75) Inventors: Xavier Jaffrezic, Velizy-villacoublay (FR); Marc Pariente, Paris (FR)

(73) Assignee: Renault S.A.S., Boulogne Billancourt (FR)

( * ) Notice: Subject to any disclaimer, the term of this patent is extended or adjusted under 35 U.S.C. 154(b) by 246 days.

(21) Appl. No.: 12/093,547

(22) PCT Filed: Sep. 28, 2006

(86) PCT No.: PCT/FR2006/050955

§ 371 (c)(1),
(2), (4) Date: Aug. 27, 2008

(87) PCT Pub. No.: WO2007/054648

PCT Pub. Date: May 18, 2007

(65) Prior Publication Data

US 2009/0091232 A1 Apr. 9, 2009

(30) Foreign Application Priority Data

Nov. 14, 2005 (FR) ..... 05 53448

(51) Int. Cl.
*H01T 13/20* (2006.01)

(52) U.S. Cl. ..... 313/141; 313/136

(58) Field of Classification Search ..... 313/118–145; 123/169 R, 169 EL, 32, 41, 310
See application file for complete search history.

(56) References Cited

U.S. PATENT DOCUMENTS

| | | | | | |
|---|---|---|---|---|---|
| 3,267,325 | A | * | 8/1966 | Frederick | 315/53 |
| 3,882,341 | A | * | 5/1975 | Green | 313/134 |
| 4,029,990 | A | * | 6/1977 | Nagy et al. | 315/62 |
| 4,405,429 | A | * | 9/1983 | Nishio | 204/421 |
| 4,613,789 | A | * | 9/1986 | Herden et al. | 315/58 |
| 4,636,690 | A | * | 1/1987 | Herden et al. | 315/58 |
| 5,463,267 | A | * | 10/1995 | Conway | 313/141 |
| 5,706,792 | A | * | 1/1998 | Boyer et al. | 123/634 |

FOREIGN PATENT DOCUMENTS

EP 0893599 1/1999

(Continued)

OTHER PUBLICATIONS

U.S. Appl. No. 11/993,930, filed Dec. 26, 2007, Jaffrezic, et al.
U.S. Appl. No. 12/064,472, filed Feb. 22, 2008, Jaffrezic, et al.

*Primary Examiner* — Nimeshkumar D Patel
*Assistant Examiner* — Donald L Raleigh
(74) *Attorney, Agent, or Firm* — Oblon, Spivak, McClelland, Maier & Neustadt, L.L.P.

(57) ABSTRACT

A spark plug for an internal combustion engine of a motor vehicle, having a substantially cylindrical general form, includes an essentially capacitive lower part and an essentially inductive upper part. The lower part includes two coaxial electrodes, including a central electrode with an axis and a shell electrode that surrounds the central electrode, and an insulator inserted between the central electrode and the shell electrode. The upper part includes a central mandrel surrounded by a coil, a bottom end part of which overlaps a top end part of the central electrode in a radial direction, an external casing, and an insulator inserted radially between the casing and the coil. The top end part of the central electrode has a coating of material which is more electrically conductive than the material of the central electrode and has no ferromagnetic properties.

8 Claims, 2 Drawing Sheets

FOREIGN PATENT DOCUMENTS

| | | | |
|---|---|---|---|
| FR | 2 859 831 | 9/2003 | |
| FR | 2 859 569 | 1/2004 | |
| FR | 2859830 | 3/2005 | |
| JP | 06-159217 | * | 7/1994 |

* cited by examiner

SPARKPLUG FOR AN INTERNAL COMBUSTION ENGINE

BACKGROUND

The invention relates to a plasma-generating spark plug, used especially for the ignition of internal combustion engines by means of electric sparks.

The spark plug for the internal combustion engine of a motor vehicle, having a substantially cylindrical general form, comprises:

- an essentially capacitive lower part comprising:
  - two coaxial electrodes: one internal electrode with an axis known as the central electrode (3) and one external electrode known as the shell surrounding the central electrode, and
  - an electrically insulating block known as the insulator inserted between the central electrode and the shell; and
- an essentially inductive upper part comprising:
  - a central mandrel surrounded by a coil, a bottom end part of which surrounds a top end part of the central electrode,
  - an external casing, and
  - an insulator inserted radially between the casing and the coil.

The publications FR 2 859 830, FR 2 859 569 and FR 2 859 831 relate to a multi-spark plug of this type integrating a series resonator. The single winding of turns of the coil allows a high quality coefficient to be achieved, which is the ratio between the energy stored in the structure and the ohmic and dielectric losses. All the energy is thus stored in magnetic form and transferred to the essentially capacitive part. Moreover, the bottom end part of the coil surrounds the top end part of the central electrode. This electromagnetic overlap zone induces eddy currents in the central electrode, which have the effect of creating extra resistance and thus of reducing the overvoltage coefficient of the coil/spark plug assembly.

BRIEF SUMMARY

In order to alleviate these drawbacks, the invention aims to decrease the dissipation of electromagnetic energy induced by the eddy currents in the central electrode in order to optimize the properties of the spark plug, in particular a high overvoltage coefficient.

To this effect, the invention provides a spark plug of the type cited hereinabove, characterized in that the top end part of the central electrode has a coating of material which is more electrically conductive than the material of the central electrode and which has no ferromagnetic properties.

According to another feature of the invention, the thickness of the coating is at least equal to the initial skin thickness of the central electrode.

According to another feature of the invention, the axial height of the coating is at least equal to the height of the top end part of the central electrode.

BRIEF DESCRIPTION OF THE DRAWINGS

Other features and advantages of the invention will become apparent on reading the description of exemplary embodiments with reference to the appended figures.

DETAILED DESCRIPTION

Figure 1:
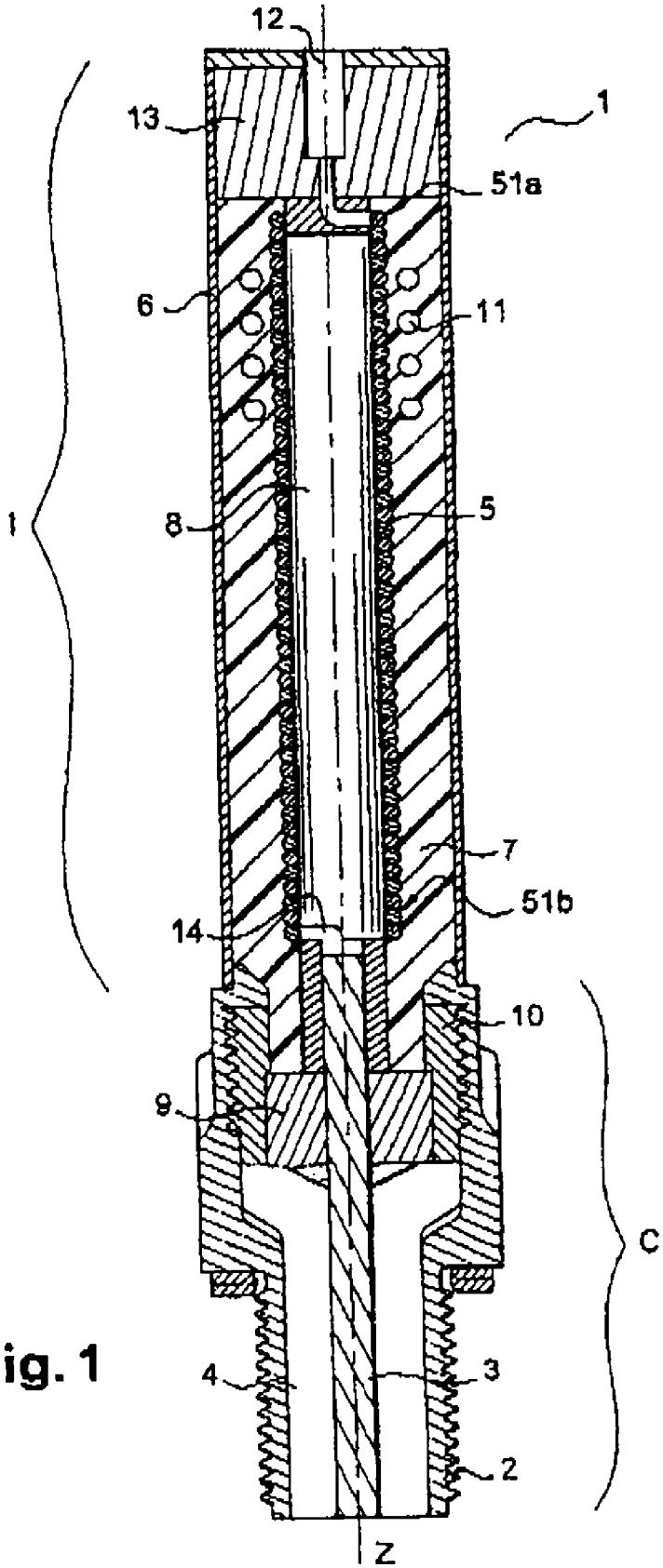
FIG. 1 shows a schematic sectional view along the axis Z of a radiofrequency plasma spark plug according to the prior art.

Identical or similar elements are designated by the same reference numerals.

As shown in FIG. 1, a radiofrequency plasma spark plug 1 having a substantially cylindrical general form with an axis Z includes principally an essentially capacitive lower part C and an essentially inductive upper part I connected in series, the parts C and I being substantially elongate in form.

The essentially capacitive part C includes in particular a shell 2 for connecting to ground and surrounding a substantially cylindrical central electrode 3 with an axis Z, which is the high voltage electrode. An electrically insulating block, known as the "insulator" 4, is positioned between the shell 2 and the central electrode 3. As is well known in the prior art, the shell 2 has, on the outer face of its lower part which is closest to the cylinder head of the internal combustion engine provided with the spark plug 1, a form suitable for installing, holding and clamping the spark plug 1 in the cylinder head (for example, and in a nonlimiting manner, as shown in FIG. 1: a thread).

The essentially inductive part I of the spark plug 1 has, from the inside to the outside: a central mandrel 8, a coil 5, an insulator 7, and an external casing 6.

The central mandrel 8 has a cylindrical general form with a circular cross section, the axis of which coincides approximately with the axis Z of the spark plug 1. It is made of an insulating and nonmagnetic material.

The coil 5 has a cylindrical general form with a circular cross section. It consists of a wound wire of diameter D forming contiguous turns 51 surrounding the central mandrel 8 starting from a first turn 51*a* as far as a last turn 51*b*, these constituting the two end turns 51*a*, 51*b* of the coil 5. The first turn 51*a* is connected to the connector 12 and the last turn 51*b* is connected by suitable means 14 to an internal end of the central electrode 3.

Figure 2:
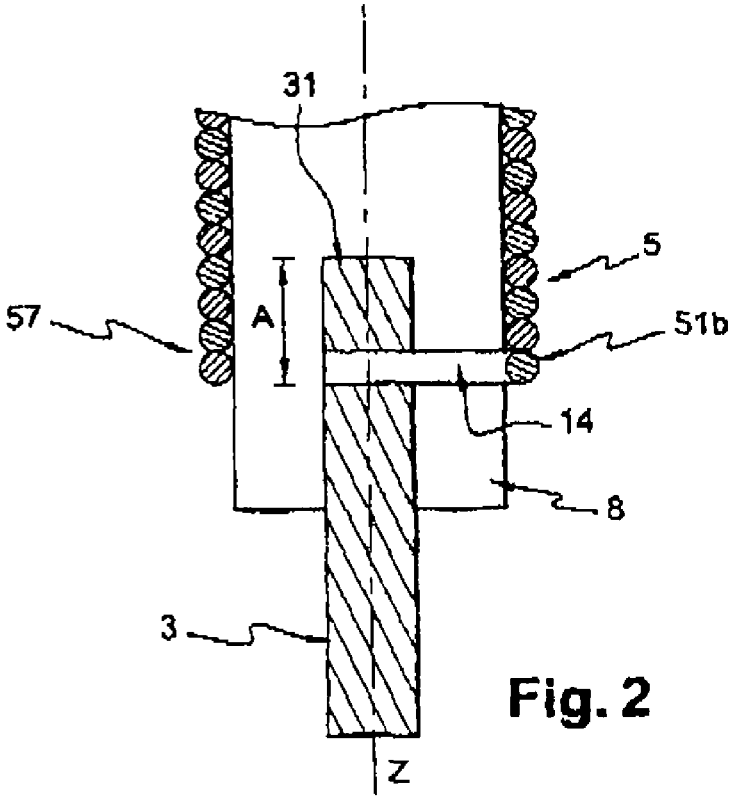
FIG. 2 shows a schematic sectional view along the axis Z of part of a radiofrequency plasma spark plug comprising a bottom end part of the coil and a top end part of the central electrode according to the prior art.

As shown in FIG. 2, a bottom end part 57 of the coil 5 surrounds a top end part 31 of the central electrode 3 which is fitted in the mandrel 8.

As shown in FIG. 1, the insulator 7 which surrounds the coil 5 has a cylindrical general form. It may be chosen from various materials such as silicone.

The external casing 6 has a cylindrical general form. It is connected to ground and surrounds the coil 5. The casing 6 has an electromagnetic shielding function. The casing 6 may be chosen from a nonferrous, highly conductive material such as copper.

Figure 3:
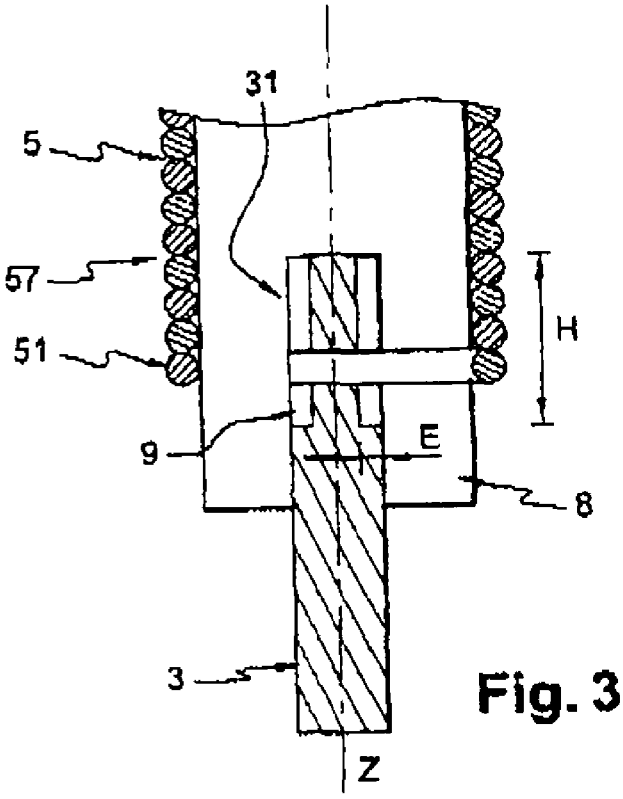
FIG. 3 shows a sectional view of a central electrode according to the invention.

As shown in FIG. 3, according to one embodiment of the invention, the central electrode 3 has a coating 9. The coating 9 is found axially on the top end part 31 of the central electrode 3. This coating 9 may be deposited for example by electrolysis.

The coating is characterized by being more electrically conductive than the material of the central electrode 3 and by having no ferromagnetic properties. For example, the central electrode 3 may be chosen from nickel, whose conductivity is $14.3*10^6$ S/m (Siemens/meter), and the coating 9 may be chosen from silver, whose electrical conductivity is $63*10^6$ S/m.

Regarding the dimensions of the coating 9, it is characterized by:

- a thickness E and
- a height H.

The radial thickness E is at least equal to the skin thickness of a central electrode with no coating 9. It will be recalled that the skin thickness is defined as the thickness in the material in question, after which the currents induced are reduced by a factor "e" (where in(e)=1). The skin thickness may be calculated using the following equation:

$$\delta = \sqrt{\frac{1}{\pi \cdot \mu \cdot \sigma \cdot f}}$$

where:

μ=permeability;

$\mu=\mu_0 \cdot \mu r$, where μr=relative permeability of the material and $\mu_0$=permeability in a vacuum;

s (S/m)=electrical conductivity; and f (Hz)=frequency in Hz.

The height H is at least equal to the height of the top end part 31 of the central electrode 3.

The bottom end part 57 of the coil 5 surrounding the top end part 31 of the central electrode 3 is known as the electromagnetic overlap zone A. This zone A induces eddy currents in the central electrode 3. The losses caused by eddy current are proportional to the square of the frequency. The skin thickness decreases in proportion to the square root of the permeability, the frequency, the electrical conductivity and the dimensions of the piece in question. The thicker the piece is in the plane perpendicular to the magnetic field in relation to the skin thickness, the higher the currents induced will be.

Since the eddy currents are found in the skin thickness of the material of the central electrode 3, one embodiment of the invention provides a coating 9 which replaces this skin thickness. This coating 9 enables a reduction in the eddy currents and the skin thickness. In this way, the resistance of the central electrode 3 is decreased. The overvoltage coefficient is thus increased and as a result the performance of the spark plug is improved.

This invention is not limited to the embodiment described and illustrated which has been given by way of example.

The invention claimed is:

1. A spark plug for an internal combustion engine of a motor vehicle, having a substantially cylindrical general form, comprising:

an essentially capacitive lower part comprising:

two coaxial electrodes including a central electrode with an axis and a shell electrode that surrounds the central electrode, and an insulator inserted between the central electrode and the shell electrode; and an essentially inductive upper part comprising:

a central mandrel surrounded by a coil, a bottom end part of the coil overlaps a top end part of the central electrode in a radial direction, an external casing, and an insulator inserted radially between the casing and the coil;

wherein the top end part of the central electrode has a coating of material that is more electrically conductive than the material of the central electrode and has no ferromagnetic properties.

2. The spark plug as claimed in claim 1, wherein a radial thickness of the coating is at least equal to an initial skin thickness of the central electrode.

3. The spark plug as claimed in claim 1, wherein an axial height of the coating is at least equal to a height of the top end part of the central electrode.

4. The spark plug as claimed in claim 1, wherein the coating comprises silver.

5. The spark plug as claimed in claim 1, wherein the central electrode comprises nickel.

6. The spark plug as claimed in claim 1, wherein the top end part of the central electrode, which is coated by the coating, is thinner than a part of the central electrode that is below the top end part.

7. The spark plug as claimed in claim 1, wherein the coil is positioned within the casing.

8. A spark plug for an internal combustion engine, comprising:

a capacitive lower part comprising:

two coaxial electrodes including a central electrode and a shell electrode that surrounds the central electrode, and an insulator inserted between the central electrode and the shell electrode; and an inductive upper part comprising:

a central mandrel surrounded by a coil, a bottom end part of the coil overlaps a top end part of the central electrode in a radial direction, an external casing, and an insulator inserted between the casing and the coil, wherein the top end part of the central electrode has a coating of material that is more electrically conductive than the material of the central electrode and has no ferromagnetic properties.

* * * * *